US005623871A

United States Patent [19]

Takahira

[11] Patent Number: 5,623,871

[45] Date of Patent: Apr. 29, 1997

[54] STENCIL DISCHARGING APPARATUS IN A STENCIL PRINTING MACHINE

[75] Inventor: Shinichi Takahira, Tokyo, Japan

[73] Assignee: Riso Kagaku Corporation, Tokyo, Japan

[21] Appl. No.: 511,854

[22] Filed: Aug. 7, 1995

[30] Foreign Application Priority Data

Aug. 8, 1994 [JP] Japan ..... 6-185790

[51] Int. Cl.[6] ..... B41L 13/14; B41L 31/00

[52] U.S. Cl. ..... 101/114; 101/116; 101/477

[58] Field of Search ..... 101/114, 116, 101/117, 118, 128.4, 477

[56] References Cited

U.S. PATENT DOCUMENTS 5,487,333 1/1996 Oshio et al. ..... 101/116

FOREIGN PATENT DOCUMENTS

A10614764 9/1994 European Pat. Off. .
58-3266 6/1983 Japan .
4-18867 4/1992 Japan .
6-255228 9/1994 Japan .

OTHER PUBLICATIONS

Patent Abstracts of Japan, vol. 12 No. 164 (M-698), May 18, 1988, & JP-A-62 279979 (Seiki Kogyo KK) Dec. 4, 1987 *abstract.

Patent Abstracts of Japan, vol. 4 No. 64 (M-011), May 14, 1980 & JP-A-55 030922 (Ricoh Co. Ltd) Mar. 5, 1980, *abstract.

*Primary Examiner*—Stephen R. Funk
*Attorney, Agent, or Firm*—Sughrue, Mion, Zinn, Macpeak & Seas

[57] ABSTRACT

A stencil discharging apparatus in a stencil printing machine which uses a stencil paper wound on the outer cylindrical surface of a rotary cylindrical drum. The stencil discharging apparatus includes: a stencil discharging claw movable between a standby position which is located near the outer cylindrical surface of the rotary cylindrical drum and is spaced a predetermined distance from the rotary cylindrical drum, and a stencil separating position which is closer to the rotary cylindrical drum, for removing the stencil paper from the rotary cylindrical drum; a used-stencil accommodating section for receiving the stencil paper thus removed from the rotary cylindrical drum by the stencil discharging claw; a conveyer for conveying the stencil paper thus removed from the rotary cylindrical drum by the stencil discharging claw to the used-stencil accommodating section; a detector for detecting whether or not the stencil discharging claw is at the standby position; and a controller, for permitting the following operation to start when the detector detects that the stencil discharging claw is at the standby position after a stencil discharging operation, and for inhibiting the starting of the following operation when the detector detects that the stencil discharging claw is not at the standby position after the stencil discharging operation.

6 Claims, 7 Drawing Sheets

STENCIL DISCHARGING APPARATUS IN A STENCIL PRINTING MACHINE

BACKGROUND OF THE INVENTION

1. Field of the Invention

This invention relates to a stencil discharging apparatus in a stencil printing machine in which a stencil wound on the rotary cylindrical drum is removed with a stencil discharging claw which is provided near the outer cylindrical surface of the drum in such a manner that the claw is movable to and from the outer cylindrical surface of the drum, and the stencil thus removed is conveyed to a used-stencil accommodating section by conveying means, where it is discarded.

2. Description of the Related Art

A stencil discharging apparatus in a stencil printing machine in which a stencil paper wound on the rotary cylindrical drum is removed with a stencil discharging claw, and the stencil thus removed is conveyed to a used-stencil accommodating section by a pair of stencil conveying rollers, is known in the art. It has been disclosed, for instance, by Unexamined Japanese Utility Model Publication No. 3266/1983 and Examined Japanese Utility Model Publication No. 18867/1992.

In the above-described conventional stencil printing machine, stencil presence or absence detecting means is provided on a conveying path along which a used stencil is conveyed to the used-stencil accommodating section, to determine whether or not a stencil is present on the conveying path. That is, the stencil presence or absence detecting means determines whether or not the detecting state of the stencil presence or absence detecting means is changed to a stencil presence state from a stencil absence state within a predetermined period after the provision of a stencil discharging operation start instruction. When it is determined that the stencil absence state is switched over to the stencil presence state within the period of time, it is permitted to perform the following operation; and when not, it is decided that the stencil is removed in an unacceptable manner, and it is inhibited to perform the following operation. In addition, the detecting means determines whether or not its detecting state is changed to the stencil absence state within a predetermined period of time after being changed to the stencil presence state. When it is determined that the stencil presence state is switched over to the stencil absence state within the predetermined period of time, it is permitted to perform the following operation; and when not, it is decided that the stencil has been removed in an unacceptable manner, and it is inhibited to perform the following operation.

In the above-described conventional stencil discharging apparatus, the stencil presence or absence detecting means, which is provided on the used-stencil conveying path, is located near the pair of used-stencil conveying rollers. More specifically, the position of the stencil presence or absence detecting means corresponds substantially to the middle of the width of the used stencil which is conveyed. Hence, when the used stencil has passed through the position, then it is decided that the used stencil paper has been discharged, and it is permitted to start the following operation.

In general, in the case where a used stencil is discarded by the stencil discharging apparatus, all the surface of the used stencil which is in contact with the rotary cylindrical drum is not stained with printing ink. That is, in the case of a stencil paper made up of a thermoplastic resin film and a porous support, all the surface on the porous support side is not stained with printing ink. More specifically, only its part corresponding to the ink passage region of the rotary cylindrical drum is stained with printing ink, and the remaining part surrounding the part is not.

The used stencil paper is folded like a meander, and accommodated in the used-stencil accommodating section this case, the part of the used stencil which has been stained with print ink is held folded by the adhesion of the ink. On the other hand, both side portions of the used stencil as viewed in the stencil discharging direction, which are not stained with printing ink, are not held folded; that is, they are gradually unfolded. In the case where the used stencil conveying means is made up of a pair of rollers, sometimes the stencil may be protruded from both ends of the rollers towards the rotary cylindrical drum.

The protrusion of the stencil is gradually spread from both ends of the pair of rollers towards the center as the number of used stencils is increased in the used stencil accommodating section. When the protrusion reaches a range where the stencil presence or absence detecting means can detect the protrusion, the protrusion is actually detected; that is, it is decided that the stencil has been removed in an unacceptable manner, and the decision is notified to the operator to allow him to deal with the trouble. However, the stencil which has been jammed to this extent cannot be removed without use of the operator's hand; that is, it is necessary for the operator to pull the stencil out of the rollers with his fingers. Hence, the operator's fingers are stained with the printing ink, and at worst the stencil paper is torn into pieces, some of which may be left between the rollers.

SUMMARY OF THE INVENTION

In view of the foregoing, an object of the invention is to provide a stencil discharging apparatus for a stencil printing machine which suitably detects when a used stencil is removed in an unacceptable manner, and detects the occurrence of a trouble earlier which is due to the stencil removed in the unacceptable manner, and prevents a stencil from being removed in the unacceptable manner.

The present applicant has found that, in the case where the used stencil is stuck out from the stencil conveying means towards the rotary cylindrical drum, after the stencil discharging operation the stencil discharging claw is not returned from the stencil separating position close to the rotary cylindrical drum to the standby position spaced a predetermined distance from the drum, and developed the present invention.

According to a first aspect of the present invention, there is provided a stencil discharging apparatus in a stencil printing machine which uses a stencil paper wound on the outer cylindrical surface of a rotary cylindrical drum, the stencil discharging apparatus comprising: a stencil discharging claw movable between a standby position which is located near the outer cylindrical surface of the rotary cylindrical drum and is spaced a predetermined distance from the rotary cylindrical drum, and a stencil separating position which is closer to the rotary cylindrical drum, for removing the stencil paper from the rotary cylindrical drum; a used-stencil accommodating section for receiving the stencil paper thus removed from the rotary cylindrical drum by the stencil discharging claw; conveying means for conveying the stencil paper thus removed from the rotary cylindrical drum by the stencil discharging claw to the used-stencil accommodating section; detecting means for detecting whether or not the stencil discharging claw is at the standby position; and control means, for permitting the following operation to start when the detecting means detects that the stencil discharging claw is at the standby position after a stencil discharging operation, and for inhibiting the starting of the following operation when the detecting means detects that the stencil discharging claw is not at the standby position after the stencil discharging operation.

According to a second aspect of the invention, there is provided a stencil discharging apparatus of the first aspect, further comprising: warning means which, when the control means decides that the stencil has been removed in an unacceptable manner, is operated to give a warning of the fact that the stencil has been removed in an unacceptable manner.

According to a third aspect, a stencil discharging apparatus in a stencil printing machine which uses a stencil paper wound on the outer cylindrical surface of a rotary cylindrical drum, the stencil discharging apparatus comprising: a stencil discharging claw movable between a standby position which is located near the outer cylindrical surface of the rotary cylindrical drum and is spaced a predetermined distance from the rotary cylindrical drum, and a stencil separating position which is closer to the rotary cylindrical drum, for removing the stencil paper from the rotary cylindrical drum; a used-stencil accommodating section for receiving the stencil paper thus removed from the rotary cylindrical drum by the stencil discharging claw; conveying means for conveying the stencil paper thus removed from the rotary cylindrical drum by the stencil discharging claw to the used-stencil accommodating section; stencil presence or absence detecting means for detecting the presence or absence of the stencil paper on the conveying path along which the stencil paper is conveyed to the used-stencil accommodating section; detecting means for detecting whether or not the stencil discharging claw is at the standby position; and control means for inhibiting the starting of the following operation, in the case where the detecting state of the stencil presence or absence detecting means is not changed to a stencil absence state within a predetermined period of time after being changed to a stencil presence state from the stencil absence state, or in the case where, after a stencil discharging operation, the detecting means detects that the stencil discharging claw is not at the standby position.

With the stencil discharging apparatus designed as described above according to the invention, the detecting means detects how the stencil discharging claw has operated after a stencil discharging operation. That is, when it is determined that the stencil discharging claw is located at the standby position which is spaced the predetermined distance from the rotary cylindrical drum, the starting of the following operation is permitted; and when it is determined that the claw is not located at the standby position; that is, when it is not returned to the standby position because the used stencil is protruded from the stencil conveying means, it is decided that it has been removed in an unacceptable manner, and the starting of the following operation is inhibited, while the warning means is operated to give a warning of the unacceptable removal of the stencil.

DETAILED DESCRIPTION OF THE PREFERRED EMBODIMENTS

Figure 1:
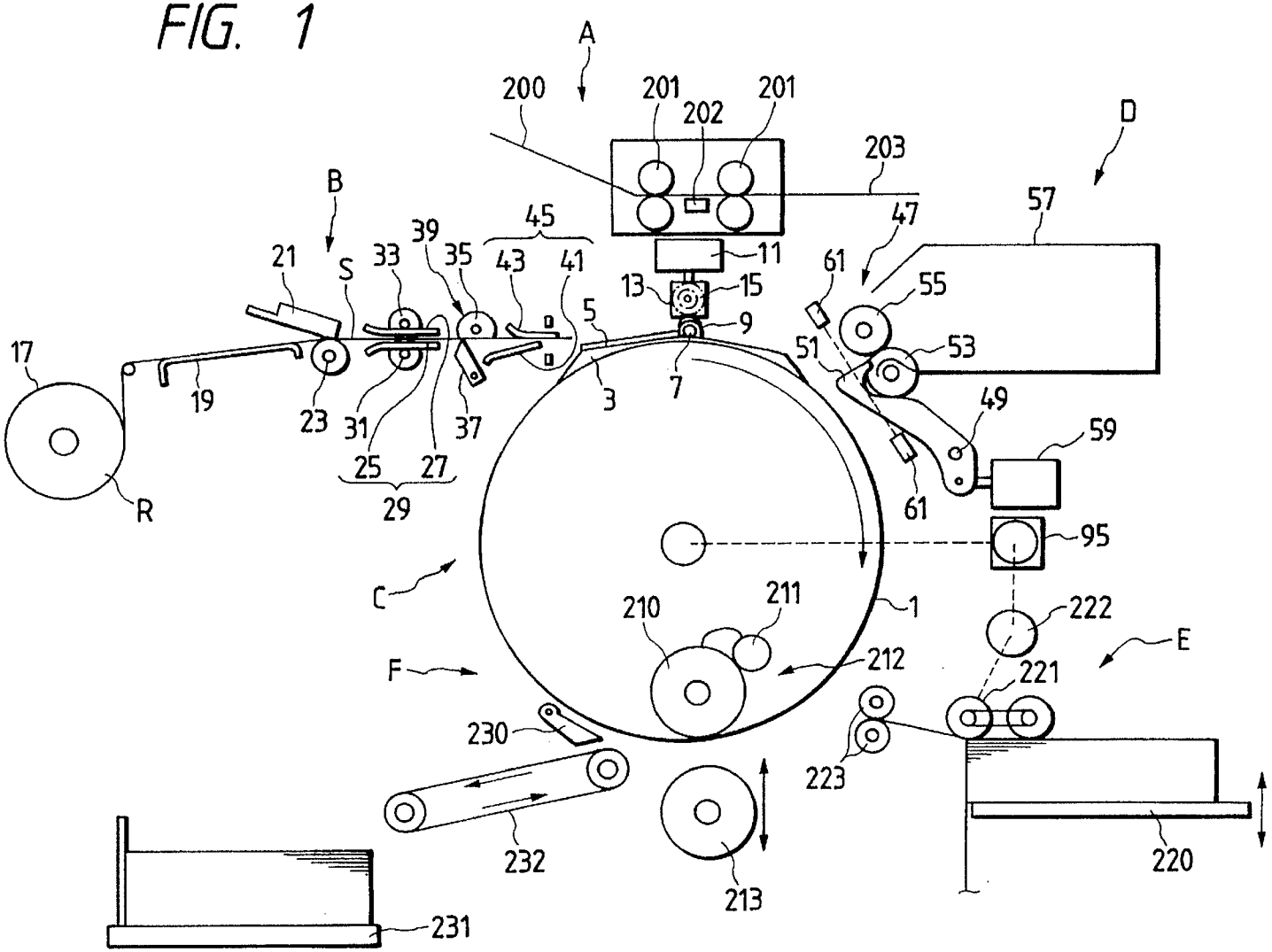
FIG. 1 is an explanatory diagram showing the arrangement of an embodiment of the invention.

FIG. 1 shows a stencil printing machine which constitutes an embodiment of the invention. The stencil printing machine has a stencil making function. The machine comprises: an original image reading section A, a heat-sensitive type stencil making section B, a stencil printing mechanism section C, a stencil discharging apparatus D, a sheet supplying section E, and a sheet discharging section F.

The original image reading section A comprises: an original placing table 200 on which an original to be read is placed; a pair of original conveying rollers 201 for conveying an original from the original placing table 200; an image sensor, for instance a contact type image sensor 202 which optically reads the image of an original and converts it into an electrical signal; and an original discharging tray 203.

The stencil making section B comprises: a stencil guiding lower plate 19; a stencil making thermal head 21; a platen roller 23 provided below the thermal head 21; a stencil inlet path 29 including a stencil guiding lower plate 25 and a stencil guiding upper plate 27 provided above the stencil guiding lower plate 25; a pair of stencil paper conveying rollers 31 and 33 arranged vertically in the stencil inlet path 29; an stencil paper cutter 39 including a stationary edge 37 and a movable edge 35 provided above the stationary edge 37; and a stencil outlet path 45 made up of a stencil guiding lower plate 41 and a stencil guiding upper plate 43 provided above the stencil guiding lower plate 41.

A stencil paper roll holding section 17, as shown in FIG. 1, is provided on the left side of the stencil making section B. The stencil paper roll holding section 17 holds a roll R of stencil paper S in such a manner that the roll R can be replaced with another one when necessary. In the stencil making section B, the platen roller 23 and the pair of stencil paper conveying rollers 31 and 33 are operated to receive the stencil paper S from the stencil paper roll holding section 17, and the stencil paper S thus received is thermally processed with the thermal head to perforate a stencil paper, and then cut with the stencil paper cutter 39 to separate the stencil paper.

The stencil printing section C has a rotary cylindrical drum 1 which is rotated around its central axis. More specifically, the rotary cylindrical drum 1 is rotated clockwise (in FIG. 1) by a main motor 95. The cylindrical wall of the rotary cylindrical drum 1 has an ink passage region serving as a printing region, and an ink non-passage region surrounding the ink passage region.

A stage member 3 is provided on the outer surface of the ink non-passage region of the cylindrical wall. The stage member 3 extends in the direction of the generating line of the cylindrical wall. On the stage member 3, a stencil clamping plate 5 is provided to cooperate with the stage member 3 to clamp one end of a stencil paper S. The stencil clamping plate 5 is mounted on a shaft 7 with a gear 9. A clamp solenoid 11 is provided on a machine body frame (not shown) which is stationary. The clamp solenoid 11 moves a clamp drive unit 13 vertically which has a drive gear 15, so as to selectively engage the drive gear 15 with the gear 9 of the shaft 7.

The drive gear 15 thus engaged with the gear 9 is rotated with an electric motor (not shown), so that the gear 9 connected to the shaft 7 of the clamp plate 5 is rotated. The clamp plate 5 is moved between a clamp position (shown in FIG. 1) where it cooperates with the stage member 3 to clamp one end of the stencil paper which is perforated by and transferred from the stencil making section, and a non-clamp position where it is swung about 180° from the clamp position.

An ink supplying mechanism 212 including a squeegee roller 210 and a doctor rod 211 is provided inside the rotary cylindrical drum 1. A press roller 213 is provided below the drum 1. The press roller 213 pushes the printing sheet against the rotary cylindrical drum 1 which has been supplied in synchronization with the rotation of the drum 1, so that the ink supplied through the rotary cylindrical drum 1 and the perforating region of the stencil is transferred onto the printing sheet.

The sheet supplying section E comprises: a sheet supplying tray 220 on which printing sheets are stacked, the tray 220 being moved vertically by a vertical moving mechanism (not shown); pick-up rollers 221 for taking printing sheets out of the sheet supplying tray 220 one at a time; a sheet supplying clutch 222 for controlling the transmission of the rotation of the main motor 95, which is adapted to drive the rotary cylindrical drum 1, to the pick-up rollers 221; and a pair of sheet conveying rollers 223 for feeding a printing sheet to the space between the drum 1 and the press roller 213 with predetermined timing.

The sheet discharging section F comprises: a sheet discharging tray 231 on which printed sheets are stacked; a separating claw 230 for separating a printed sheet from the rotary cylindrical drum 1; and a belt-conveyor-type printed-sheet conveying unit 232 adapted to convey to the sheet discharging tray 231 the printed sheet which has been separated from the drum 1 with the separating claw 230.

Figure 2:
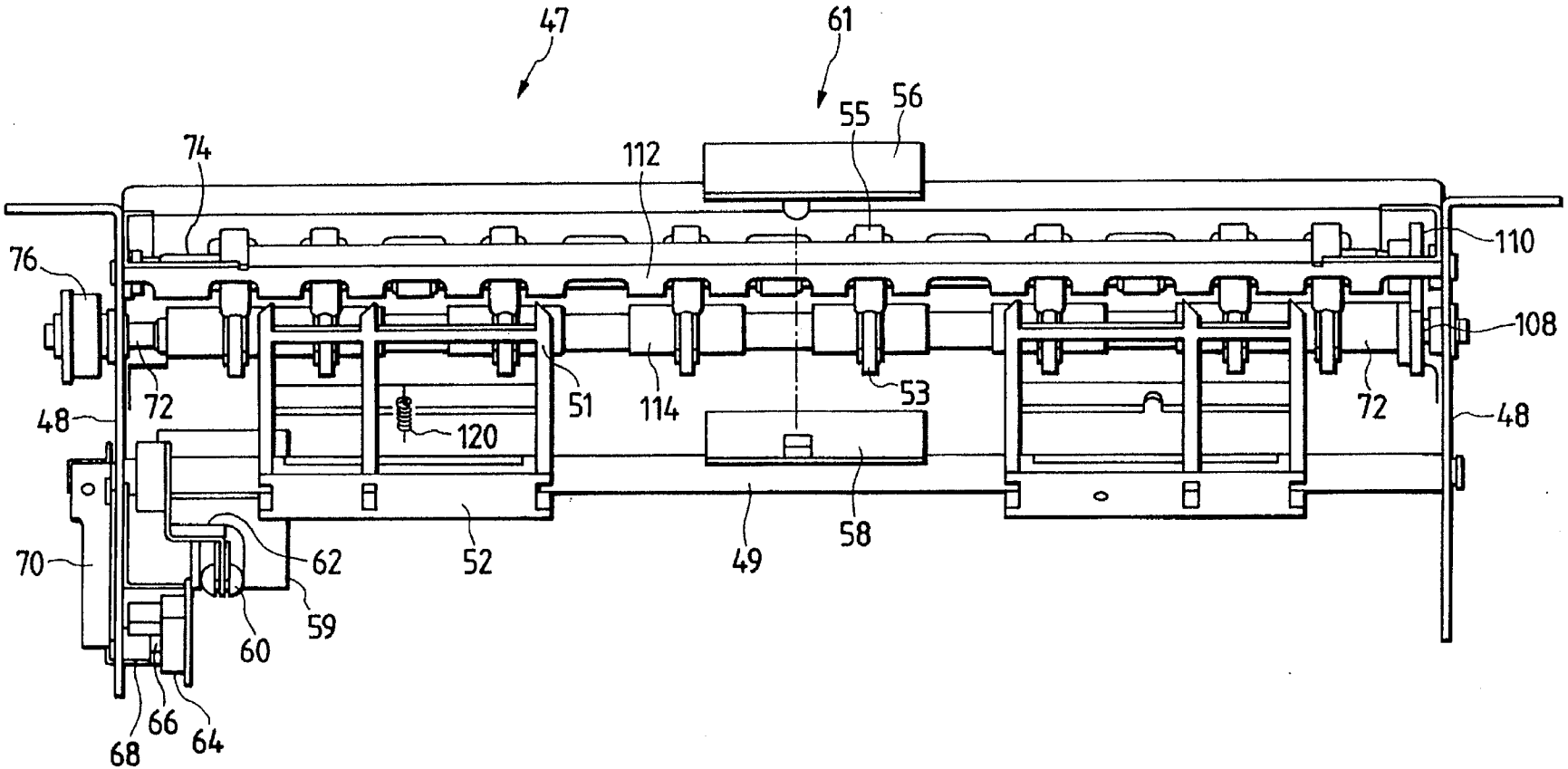
FIG. 2 is an explanatory diagram showing a stencil discharging apparatus in part according to the embodiment as viewed in the direction of conveyance of a stencil.
Figure 3:
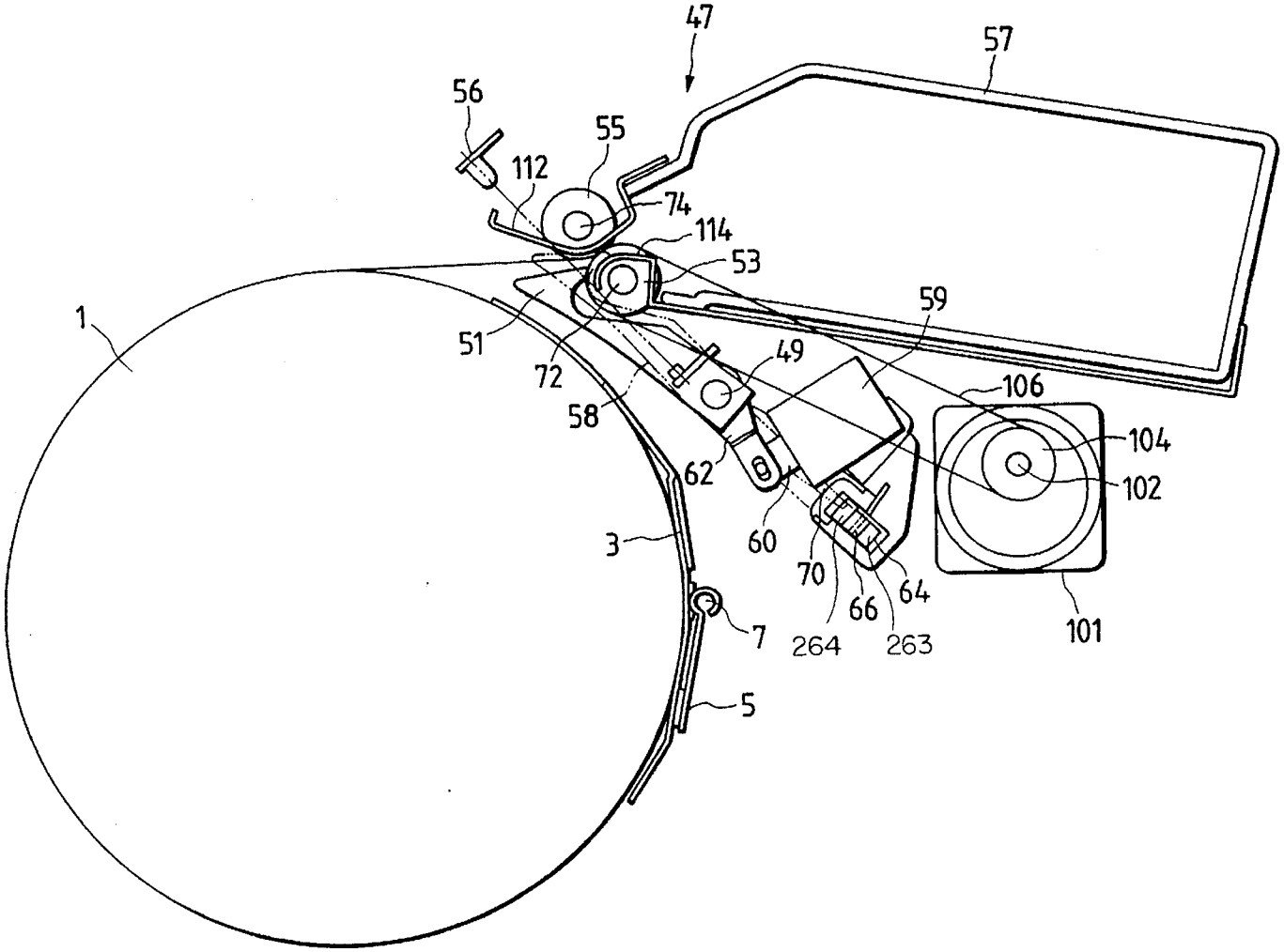
FIG. 3 is a sectional view showing the stencil discharging apparatus in part according to the embodiment of the invention.
Figure 4:
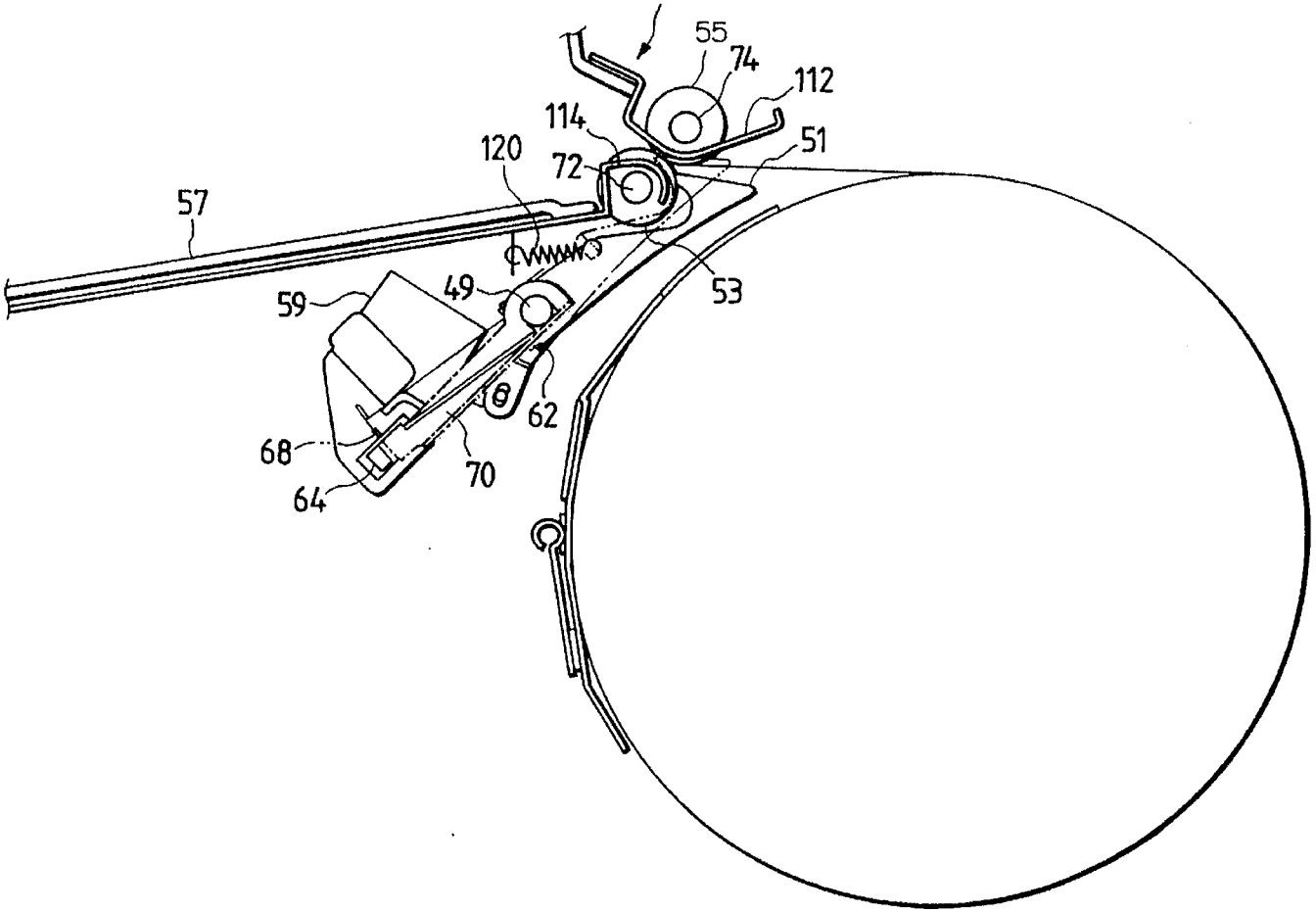
FIG. 4 is a sectional view showing the stencil discharging apparatus in part, which is opposite to the sectional view of FIG. 3.

The stencil discharging apparatus D is provided on one side of the rotary cylindrical drum 1 which is opposite to the other side where the stencil making section B is provided. As shown in FIGS. 2, 3 and 4, a stencil-discharging-claw drive shaft 49 is rotatably supported between both side plates 48 which are fundamental components of the stencil discharging apparatus D. The stencil-discharging-claw drive shaft 49 has a stencil discharging claw 51. The stencil discharging claw 51 is provided as a pair of units 52 each made up of a plurality of claws. The pair of units 52 are arranged over the stencil-discharging-claw drive shaft 49 in such a manner that the units 52 are equally spaced from the center of the shaft 49.

As shown in FIG. 2, a solenoid 59 is mounted on one of the side plates 48, and one end portion of a coupling lever 62 is fixedly connected to the stencil-discharging-claw drive shaft 49. The other end portion of the coupling lever 62 is swingably coupled to the end portion of the movable iron core 60 of the solenoid 59. Hence, when the solenoid 59 is activated to move the movable iron core 60, the drive shaft 49 is turned. As the drive shaft 49 is turned in this manner, the stencil discharging claw 51 is swung between a standby position (indicated by the phantom lines in FIGS. 3 and 4) which is spaced a predetermined distance from the rotary cylindrical drum 1 and a stencil separating position (indicated by the solid lines in FIGS. 3 and 4). The stencil discharging claw 51, when positioned at the stencil separating position, approaches the rotary cylindrical drum 1 to separate one end portion of the stencil S from the outer cylindrical surface of the drum 1, and then leads it to the space between a pair of rollers which form conveying means (described later).

One end portion of a detecting lever 70 is fixedly connected to one end of the stencil-discharging-claw drive shaft 49, and the other end portion of the detecting lever 70 has a detecting probe 68. The side plate 48 near the one end portion of the stencil-discharging-claw drive shaft 49 has detecting means, namely, a stencil-discharging-claw sensor 64. The sensor 64 comprises: a light emitting section 264 and a light receiving section 263 which are arranged, in the form of the character "U", along a slit 66. The detecting probe 68 of the detecting lever 70 is caused to go through the slit 66 of the stencil-discharging-claw sensor 64 as the stencil-discharging-claw drive shaft 49 is turned; that is, as the stencil discharging claw 51 is turned.

When, as indicated by the phantom lines in FIG. 4, the stencil discharging claw 51 is at the standby position which is spaced a predetermined distance from the rotary cylindrical drum 1, the detecting probe 68 of the detecting ever 70 is positioned in the slit 66 of the stencil-discharging-claw sensor 64. In this case, light emitted from the light emitting section is intercepted by the detecting probe 68, so that the stencil-discharging-claw sensor 64 outputs an "off" signal. In response to the "off" signal, a stencil discharging operation is started. That is, the solenoid 59 is driven, so that the stencil-discharging-claw drive shaft 49 is turned.

In the case where, as indicated by the solid lines in FIG. 4, the stencil discharging claw 51 is located at the stencil separating position which is close to the rotary cylindrical drum 1, the detecting lever 70 has been swung, so that its detecting probe 68 is located outside the slit 66 of the stencil-discharging-claw sensor 64. Hence, the output light of the light emitting section is received by the light receiving section, so that the stencil-discharging-claw sensor 64 outputs an "on" signal.

On the other hand, rotary shafts 72 and 74 are rotatably supported between the two side plates 48. Those rotary shafts 72 and 74 are provided with a plurality of pairs of rollers which are arranged in the axial direction. One of each pair of rollers is a gear roller 53 made up of a gear-shaped rigid body, and the other of each pair of rollers is an elastic roller 55 made of an elastic material such as rubber, thus both serving as means for conveying a used stencil S. That is, those rollers convey towards a used-stencil accommodating box 57 the used stencil S which has been separated from the rotary cylindrical drum 1.

The gear rollers 53 are provided for the lower rotary shaft 72 for the following purposes: One of the purposes is to eliminate the difficulty that, in conveying a used stencil to the used stencil accommodating box 75, the rollers slip on the inked surface, thus being unable to correctly convey the used stencil. Another purpose is to allow the gear rollers 53 to cooperate with the elastic rollers 55 to hold the used stencil between them thereby to positively convey it.

A pulley 76 is mounted on one end portion of the rotary shaft 72. Torque transmitting means, namely, a driving endless belt 106 is laid over the pulley 76 and a pulley 104 mounted on the output shaft 102 of an electric motor 101 which is provided to drive the rotary shaft 72.

Hence, as the motor 101 rotates, the rotary shaft 72 is driven. On the other hand, a gear 108 is mounted on the other end portion of the rotary shaft 72, in such a manner that the gear 108 is engaged with a gear 110 which is mounted on one end portion of the rotary shaft 74. Hence, as the rotary shaft 72 is rotated, the rotary shaft 74 is turned in the opposite direction in synchronization with the rotary shaft 72.

An upper guide member and a lower guide member, namely, an upper guide plate 112 and a lower guide plate 114 are provided between the side plates 48. More specifically, the upper guide plate 112 and the lower guide plate 114 are vertically spaced a predetermined distance from each other to substantially cover the gap in each of the pairs of rollers 55 and 53 and the axial gaps between the pairs of rollers 55 and 53, thereby to prevent the stencil S from being caught between the rotary shafts 72 and 74.

The lower guide plate 114 extends in the direction of conveyance of the stencil S. The used stencil accommodating box 57 can be detachably mounted on the lower guide plate 114.

As shown in FIG. 2, stencil presence or absence detecting means, namely, a used-stencil sensor 61 is so positioned that it is on the bisector at the middle of each of the rotary shafts 72 and 74 and in front of the pairs of rollers (on the side of the rotary cylindrical drum 1). The used-stencil sensor 61 is, for instance an optical sensor, which comprises: a light emitting section 56; and a light receiving section 58 provided below the light emitting section 56 to receive the output light of the light emitting section 56. That is, the sensor 61 is to detect the passage of a stencil S separated from the drum 1.

If, when a stencil paper S passes through the space between the light emitting section 56 and the light receiving section 58, or the conveyance is stopped for some reason while the stencil paper S is passing through the space, then the stencil S may be jammed. In this case, the output light of the light emitting section 56 is intercepted by the stencil S, so that the used-stencil sensor 61 outputs an "on" signal. When no stencil is present between the light emitting section 56 and the light receiving section 58, the output light of the light emitting section 56 is received by the light receiving section 58, so that the used-stencil sensor 61 outputs an "off" signal.

As shown in FIGS. 2 and 4, the front end portion of the stencil discharging claw 51 is coupled through a tension spring 120 to the lower guide plate 114; that is, the stencil discharging claw 51 is urged counterclockwise about the stencil-discharging-claw drive shaft 49 by the tension spring 120. The stencil discharging claw 51 is stopped with its front end portion in contact with the lower surface of the upper guide plate 112; that is, the stencil discharging claw 51 is at the aforementioned standby position. In this case, the detecting probe 68 is in the slit 66 of the stencil-discharging-claw sensor 64, and the latter 64 outputs the "off" signal.

Figure 5:
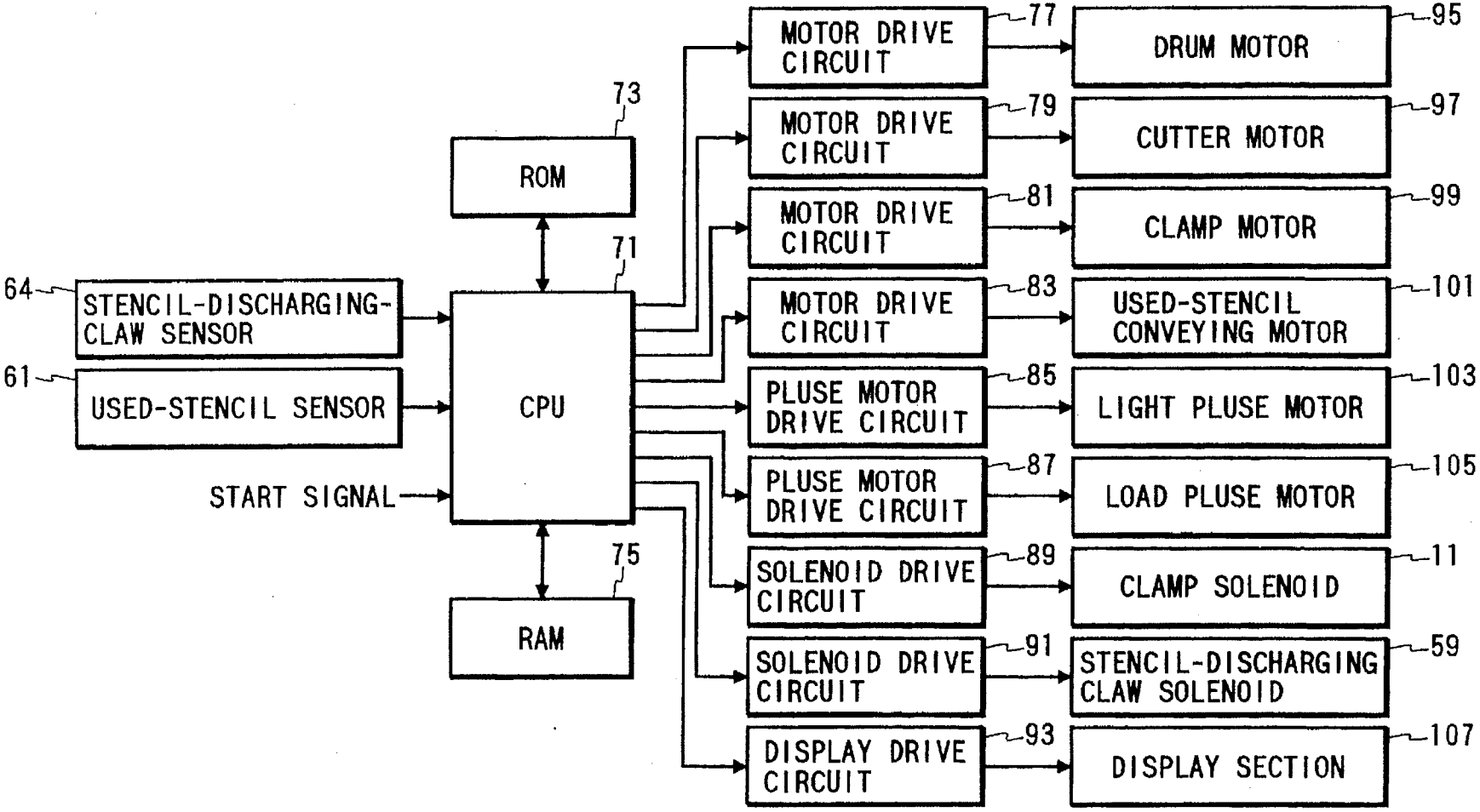
FIG. 5 is a block diagram showing the arrangement of a control system in the embodiment of the invention.

FIG. 5 shows an example of a control system in the stencil printing machine. The control system comprises: control means made up of a microprocessor, namely, a CPU 71; a ROM 73 in which a control program has been stored; and a RAM 75 for storing input data, timer measurement values, etc. as required. The control system receives data from the used-stencil sensor 61 and the stencil-discharging-claw sensor 64, and applies instructions to four motor drive circuits 77, 79, 81 and 83, two pulse motor drive circuits 85 and 87, two solenoid drive circuits 89 and 91, and a display drive circuit 93.

The motor drive circuit 77 is connected to a drum motor 95 adapted to rotate the rotary cylindrical drum 1; the motor drive circuit 79 is connected to a cutter motor 97 adapted to drive a movable cutting edge 35; the motor drive circuit 81 is connected to a clamp motor 99 adapted to drive the drive gear 15; and the motor drive circuit 83 is connected to a used-stencil conveying motor 101 adapted to drive the used-stencil conveying roller pairs. The pulse motor drive circuit 85 is connected to a write pulse motor 103 adapted to turn the platen roller 23; and the pulse motor drive circuit 87 is connected to a load pulse motor 105 adapted to turn the stencil paper conveying roller 31. The solenoid drive circuit 89 is connected to the clamp solenoid 11; and the solenoid drive circuit 91 is connected to the stencil-discharging-claw solenoid 59. The display drive circuit 93 is connected to a display section 107 such as a liquid crystal type display unit.

The CPU 71 executes the control program. The fundamental functions of the control program are as follows: That is, the CPU 71 detects whether or not the detecting state of the used-stencil sensor 61, after being changed to a stencil presence state from a stencil absence state, is changed to the stencil absence state again within a predetermined period of time. When it is determined that the detecting state of the sensor 61 is changed to the stencil absence state within the predetermined period of time, the CPU 71 permits the following operation to start; and when not, the CPU decides that the used stencil has been removed in an unacceptable manner, and inhibits the starting of the following operation, and applies an instruction to the display drive circuit 93 to display the warning that the used-stencil has been removed in the unacceptable manner.

The CPU determines from the result of detection of the stencil-discharging-claw sensor 64 whether or not the stencil discharging claws 51 are at the standby position after a stencil discharging operation. When they are at the standby position, the CPU permits the following operation to start; and when not, similarly as in the above-described case, the CPU decides that the used stencil has been removed in an unacceptable manner, and inhibits the starting of the following operation, and applies the instruction to the display drive circuit 93 to display the warning that the used-stencil has been removed in the unacceptable manner.

Figure 6:
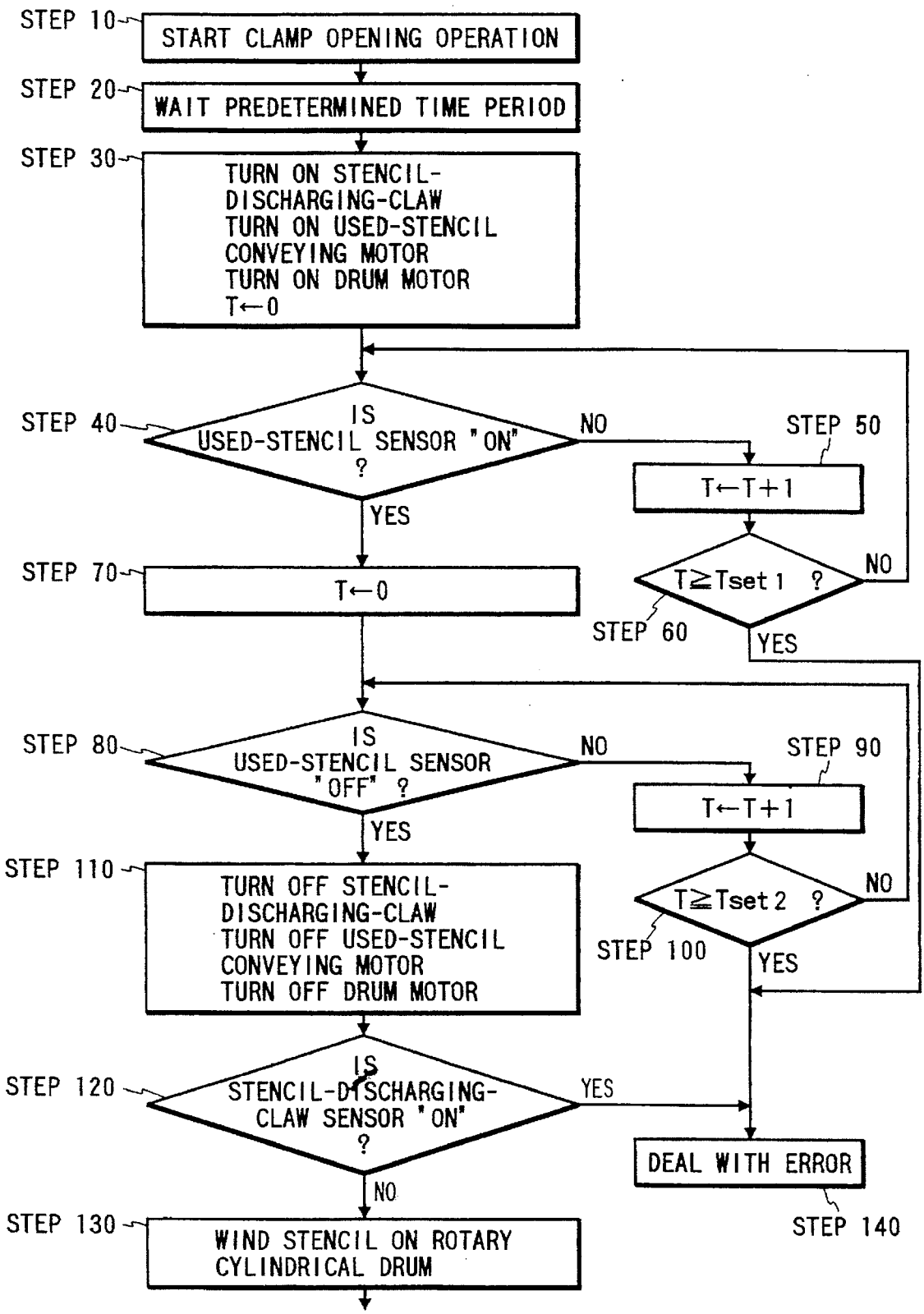
FIG. 6 is a flow chart for a description of the operation of the embodiment of the invention.
Figure 7:
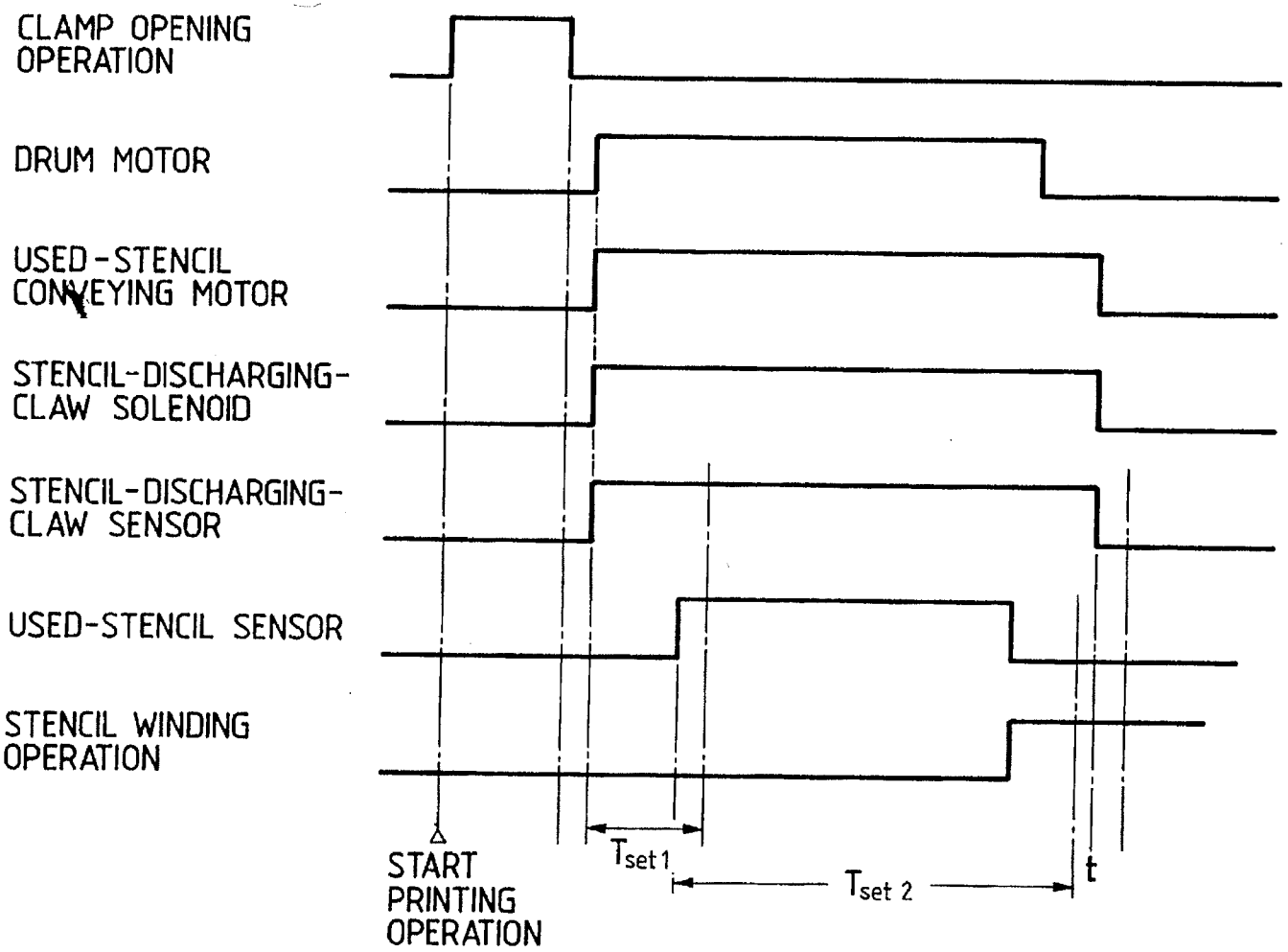
FIG. 7 is a time chart for a description of the operation of the embodiment of the invention.

FIGS. 6 and 7 are a flow chart and a time chart, respectively, for a description of the stencil discharging operation. When the operator operates a stencil making start button on the operating panel (not shown), the original image reading section A starts its original reading operation, and in accordance with an image signal outputted by the section A, the stencil making section B perforates a stencil paper by using the stencil paper S. Before the stencil paper thus perforated is wound on the rotary cylindrical drum 1, the stencil discharging operation is started. First, the clamp solenoid 11 is activated, so that the drive gear 15 is engaged with the gear 9 with the drum 1 held at the initial start position. The clamp motor 99 is operated to perform a clamp opening operation to swing the clamp 5 to the clamp releasing position (Step 10).

After the clamp opening operation, the clamp solenoid 11 is operated to disengage the drive gear 15 from the gear 9, so that the stencil discharging operation is started.

The stencil discharging operation is carried out as follows: The stencil-discharging-claw solenoid 59 is activated, so that the stencil discharging claw 51 is held at the stencil separating position indicated by the solid lines in FIGS. 3 and 4. The used-stencil conveying motor 101 is operated to turn the gear rollers 53 and the elastic rollers 55, and the drum motor 95 is operated to turn the rotary cylindrical drum 1. In synchronization with those operations of the motors, in the CPU 71 the timer value is reset to "0" (Step 30).

In this operation, as shown in FIGS. 3 and 4, the stencil discharging claw 51 is swung about the stencil-discharging-claw drive shaft 49 from the standby position to the stencil separating position where a stencil S is separated from the drum 1. At the same time, the detecting lever 70 secured to the drive shaft 49 is swung, so that the detecting probe 68 connected to the end of the detecting lever 70 is moved out of the slit 66 of the stencil-discharging-claw sensor 64. As a result, the result of detection of the stencil-discharging-claw sensor 64 is changed, and the output signal is changed to "on" level from "off" level.

Hence, as the rotary cylindrical drum 1 is turned, the stencil S is removed from the outer cylindrical surface of the latter 1 with the claw 51, and is conveyed while being held by the gear rollers 53 and the elastic rollers 55, thus being sent into the used-stencil accommodating box 57.

After the stencil discharging operation has been started in the above-described manner, it is determined whether or not the detecting state of the used-stencil sensor 61 is changed from the stencil absence state to the stencil presence state within a period of time, for instance two (2) seconds, which is predetermined from a timer set value $T_{SET1}$. That is, it is detected whether or not the output signal of the sensor 61 is changed from "off" level to "on" level (Steps 40, 50 and 60).

In the case where the output signal of the used-stencil sensor 61 is not changed from "off" level to "on" level within the predetermined period of time, it is decided that, the stencil S being jammed, its front end portion is not passed through the predetermined region in front of the gear rollers 53 and the elastic rollers 55 yet. In this case, a stencil removal error eliminating operation is carried out, and the starting of the following operation is inhibited, and an instruction is applied to the display drive circuit 93 to cause the display section 107 to display the fact that the stencil paper has been removed in an unacceptable manner (Step 140).

On the other hand, in the case where the output signal of the used-stencil sensor 61 is changed from "off" level to "on" level within the predetermined period of time, it is decided that the front end portion of the stencil S is passed through the predetermined region in front of the gear rollers 53 and the elastic rollers 55; that is, the stencil paper S is correctly discharged. In this case, in the CPU 71, the timer value T is reset (Step 70).

Thereafter, it is determined whether or not the detecting state of the used-stencil sensor 61 is changed from the stencil presence state to the stencil absence state within a period of time, for instance ten seconds, from the next time instant which is predetermined according to a timer set value $T_{SET2}$; that is, in this case, it is determined whether or not the output signal of the used-stencil sensor 61 is set to "off" level from "on" level (Steps 80, 90 and 100 ).

In the case where, after being raised to "on" level, the output signal of the used-stencil sensor 61 is not set to "off" level within a period of time which is determined from a timer set value $T_{SET2}$, it is decided that, the stencil is for instance jammed, and its rear end portion does not pass through the predetermined region in front of the gear rollers 53 and the elastic rollers 55. In this case, the stencil removal error eliminating operation is carried out, and the starting of the following operation is inhibited, and an instruction is applied to the display drive circuit 93 to cause the display section 107 to display the fact that the stencil paper has been removed in an unacceptable manner (Step 140).

On the other hand, in the case where, after being raised to "on" level, the output signal of the used-stencil sensor 61 is changed to "off" level within the period of time which is determined according to the timer set value $T_{SET2}$, it is decided that the rear end portion of the stencil S has passed through the region in front of the gear rollers 53 and the elastic rollers 55; that is, the stencil has been correctly discharged. In this case, the drum motor 95 is turned off to stop the rotation of the rotary cylindrical drum 1, and the stencil-discharging-claw solenoid 59 is turned off to return the stencil discharging claw to the standby position; and the used-stencil conveying motor 101 is turned off to stop the gear rollers 53 and the elastic rollers 55. Thus, the stencil discharging operation has been accomplished (Step 110).

Next, it is determined whether or not the output signal of the stencil-discharging-claw sensor 64 has been changed from "on" level to "off" level (Step 120). In the case where the output signal of the sensor 64 is maintained at "on" level, at least a part of the stencil paper S, except the middle portion as viewed in the direction of width of the latter S which corresponds in position to the used-stencil sensor 61, is protruded from the gear rollers 53 and the elastic rollers 66 towards the rotary cylindrical drum 1, whereby the stencil discharging claw 51 is not returned to the standby position. When this difficulty occurs, in the next stencil forming operation the used stencil is not correctly removed; that is, it is liable to be jammed with high probability. Accordingly, in this case, the stencil removal error eliminating operation is carried out, and control is made to inhibit the starting of the following operation such as a printing operation and a stencil making operation, and an instruction is applied to the display drive circuit 93 to cause the display section 107 to display the fact that the stencil paper has been removed in an unacceptable manner (Step 140).

On the other hand, in the case where, the output signal of the sensor 64 is changed from "on" level to "off" level, the stencil S to be discharged is, in its entirety, passed through the predetermined region in front of the gear rollers 53 and the elastic rollers 55; that is, it has been removed correctly. In this case, a stencil loading operation is started immediately; that is, a new stencil S perforated by the stencil making section B is wound on the rotary cylindrical drum 1 (Step 130). Next printing operation and/or next stencil making operation is permitted to start.

In the above embodiment, in the case where the output signal of the sensor 64 is maintained at "on" level, the starting of both the printing operation and the stencil making operation is inhibited. However, because jams often occur according to next stencil discharging operation under these circumstances, to inhibit only the stencil discharging operation in the next stencil making operation may be sufficient to avoid the jams. That is, a stencil winding operation and the printing operation thereafter may be permitted, and only the next stencil making operation may be inhibited.

In the stencil discharging apparatus according to the invention, the simple mechanism operates to detect the operation of the stencil discharging claw, so that it is suitably and positively determined whether or not the used stencil is removed in an unacceptable manner. Hence, the occurrence of a trouble due to the unsatisfactory removal of the used stencil can be detected earlier, and the stencil is prevented from being removed in an unacceptable manner.

What is claimed is:

1. A stencil discharging apparatus in a stencil printing machine which uses a stencil paper wound on an outer cylindrical surface of a rotary cylindrical drum, said stencil discharging apparatus comprising:

a stencil discharging claw;

moving means for moving said stencil discharging claw between a standby position which is located near the outer cylindrical surface of said rotary cylindrical drum and is spaced a predetermined distance from the rotary cylindrical drum, and a stencil separating position which is closer to the rotary cylindrical drum, for removing the stencil paper from the rotary cylindrical drum;

a used-stencil accommodating section for receiving the stencil paper thus removed from the rotary cylindrical drum by said stencil discharging claw;

conveying means for conveying the stencil paper thus removed from the rotary cylindrical drum by said stencil discharging claw to said used-stencil accommodating section;

detecting means for detecting whether said stencil discharging claw is at said standby position; and control means for executing a problem control signal indicating that the stencil paper has not been removed in an acceptable manner when said detecting means detects that said stencil discharging claw is not at said standby position after the stencil discharging operation.

2. A stencil discharging apparatus according to claim 1, further comprising:

warning means for providing a warning of the fact that said stencil has been removed in an unacceptable manner in response to said problem control signal.

3. A stencil discharging apparatus according to claim 1, wherein said detecting means includes:

a light emitting section for emitting a light;

a light receiving section provided with a slit between said light emitting section and said light receiving section, said light receiving section for receiving the light from said light emitting section; and a detecting probe connected to said stencil discharging claw, said detecting probe movable such that said detecting probe is in said slit when said stencil discharging claw is at said standby position, and that said detecting probe is out of said slit when said stencil discharging claw is at said stencil separating position.

4. A stencil discharging apparatus in a stencil printing machine which uses a stencil paper wound on an outer cylindrical surface of a rotary cylindrical drum, said stencil discharging apparatus comprising:

a stencil discharging claw;

moving means for moving said stencil discharging claw between a standby position which is located near the outer cylindrical surface of said rotary cylindrical drum and is spaced a predetermined distance from the rotary cylindrical drum, and a stencil separating position which is closer to the rotary cylindrical drum, for removing the stencil paper from the rotary cylindrical drum;

a used-stencil accommodating section for receiving the stencil paper thus removed from the rotary cylindrical drum by said stencil discharging claw;

conveying means for conveying the stencil paper thus removed from the rotary cylindrical drum by said stencil discharging claw to said used-stencil accommodating section;

stencil presence or absence detecting means for detecting the presence or absence of the stencil paper on a conveying path along which the stencil paper is conveyed to said used-stencil accommodating section within a predetermined time period;

detecting means for detecting whether or not said stencil discharging claw is at said standby position; and control means for providing a problem control signal, in the case where the detecting state of said stencil presence or absence detecting means is not changed to a stencil absence state within said predetermined period of time after being changed to a stencil presence state from the stencil absence state, or in the case where, after a stencil discharging operation, said detecting means detects that said stencil discharging claw is not at said standby position.

5. A stencil discharging apparatus according to claim 4, wherein said detecting means includes:

a light first emitting section for emitting a light;

a light first receiving section provided with a first slit between said first light emitting section and said first light receiving section, said first light receiving section for receiving the light from said first light emitting section; and a detecting probe connected to said stencil discharging claw, said detecting probe movable such that said detecting probe is in said first slit when said stencil discharging claw is at said standby position, and that said detecting probe is out said first slit when said stencil discharging claw is at said stencil separating position.

6. A stencil discharging apparatus according to claim 4, wherein said stencil presence or absence detecting means includes:

a second light emitting section, provided between the rotary cylindrical drum and said used-stencil accommodating section, said second light emitting section for emitting a light;

a second light receiving section provided separately from said second light emitting section, said second light receiving section for receiving the light from said second light emitting section.

* * * * *